US005162064A

United States Patent [19]

Kim et al.

[11] Patent Number: 5,162,064

[45] Date of Patent: Nov. 10, 1992

[54] PERMANENT MAGNET HAVING IMPROVED CORROSION RESISTANCE AND METHOD FOR PRODUCING THE SAME

[75] Inventors: Andrew S. Kim, Pittsburgh; Floyd E. Camp, Trafford; Edward J. Dulis, Pittsburgh, all of Pa.

[73] Assignee: Crucible Materials Corporation, Pittsburgh, Pa.

[21] Appl. No.: 507,026

[22] Filed: Apr. 10, 1990

[51] Int. Cl.[5] ..... H01F 1/053

[52] U.S. Cl. ..... 148/302; 420/83; 420/121; 75/233; 75/237; 75/244

[58] Field of Search ..... 148/302; 420/83, 121; 75/233, 237, 244

[56] References Cited

U.S. PATENT DOCUMENTS 4,588,439 5/1986 Narasimhan et al. ..... 148/302

FOREIGN PATENT DOCUMENTS 0255939 2/1988 European Pat. Off. ..... 148/302
0280599 11/1988 European Pat. Off. .
3637521 5/1988 Fed. Rep. of Germany ..... 148/302
63-38555 2/1988 Japan .

OTHER PUBLICATIONS

Patent Abstracts of Japan, vol. 11, No. 381 (C-464)[2828], Dec. 12, 1987; Japanese Patent Document No. 62-151542, dated Jul. 6, 1987, S C S K.K. (Ichinose).

Patent Abstracts of Japan, vol. 11, No. 361 (C-459)[2808], Nov. 25, 1987; Japanese Patent Document No. 62-133040, dated Jun. 16, 1987, Shin Etsu Chem. Co., Ltd. (Ohashi).

Patent Abstracts of Japan, vol. 13, No. 139 (E-738)[3487], Apr. 6, 1989; Japanese Patent Document No. 63-301505, dated Dec. 8, 1988, Hitachi Metals Ltd. (Kobayashi).

IEEE Transactions on Magnetics, vol. 26, No. 5, Sep. 1990, pp. 1936-1938; "Effect of Oxygen, Carbon, and Nitrogen Contents on the Corrosion Resistance of Nd--Fe-B Magnets", Kim et al.

*Primary Examiner*—John P. Sheehan
*Attorney, Agent, or Firm*—Finnegan, Henderson, Farabow, Garrett & Dunner

[57] ABSTRACT

A permanent magnet of the neodymium-iron-boron type having improved corrosion resistance imparted by a combination of oxygen, carbon and nitrogen. Oxygen is provided in an amount equal to or greater than 0.6 weight percent in combination with carbon of 0.05-0.15 weight percent and nitrogen 0.15 weight percent maximum. Preferably, oxygen is within the range of 0.6-1.2% with carbon of 0.05-0.1% and nitrogen 0.02-0.15 weight percent or more preferably 0.04-0.08 weight percent. The magnet may be heated in an argon atmosphere and thereafter quenched in an atmosphere of either argon or nitrogen to further improve the corrosion resistance of the magnet.

2 Claims, 8 Drawing Sheets

PERMANENT MAGNET HAVING IMPROVED CORROSION RESISTANCE AND METHOD FOR PRODUCING THE SAME

BACKGROUND OF THE INVENTION

1. Field of the Invention

This invention relates to a permanent magnet having improved corrosion resistance and to a method for producing the same.

2. Description of the Prior Art

It is known to produce permanent magnets of a rare earth element-iron-boron composition to achieve high energy product at a lower cost than samarium cobalt magnets. These magnets do, however, exhibit severe corrosion by oxidation in air, particularly under humid conditions. This results in degradation of the magnetic properties during use of the magnet.

Efforts have been made to improve the corrosion resistance of these magnets, such as by applying metallic platings thereto, using aluminum-ion vapor deposition coatings, organic resin coatings, synthetic resin coatings, metal-resin double layer coatings, as well as combinations of these coating systems. In addition, chemical surface treatments have been employed with these magnets in an attempt to improve the corrosion resistance thereof.

Metallic platings, applied by electro or electroless plating practices, provide platings of nickel, copper, tin and cobalt. These practices have been somewhat successful in improving the corrosion resistance of these magnets. Problems may result with this plating practice from the acidic or alkaline solutions used in the pretreatment employed prior to the plating operation. These solutions may remain in the porous surface of the magnet or may react with neodymium-rich phases thereof to form unstable compounds. These unstable compounds react during or after plating to cause loss of plating adhesion. With metallic platings, it is common for the plating to exhibit microporosity which tends to accelerate reaction of unstable phases. For example, if there is a reactive media, such as a halide, in the environment, such as is the case with salt water, a galvanic reaction may result between the metallic plating and the unstable phases of the magnet.

With aluminum-ion vapor deposition no pretreatment is required and thus the problems of metallic platings in this regard are avoided. Coatings of this type, however, are characterized by significant microporosity because of the nonuniform deposition of the coating on the surface of the magnet. In addition, this practice is not amenable to mass production processes and thus is too expensive for commercial application.

The use of resin coatings suffer from poor adhesion to result in the gradual removal of the coating followed by oxidation of the magnet surface at the removed coating portion thereof.

Metallic-resin double layered coatings if not applied in a continuous fashion result in accelerated, spreading corrosion from any areas of coating discontinuity.

Chemical surface treatments, including chromic acid, hydrofluoric acid, oxalic acid or phosphate treatments, all suffer from the disadvantage of requiring expensive equipment to comply with environmental regulations. Consequently, these practices are not commercially feasible from the cost standpoint.

All of the conventional methods for improving the corrosion resistance of permanent magnets of this type suffer from the same deficiency in that the corrosion protection is obtained by a surface treatment of the magnet. Accordingly, the magnet per se is not stabilized with respect to corrosion by any of these surface-treatment practices.

It is known to vary the composition of the magnet to improve the corrosion resistance thereof. Alloy modifications of this type are disclosed in Narasimhan et al., U.S. Pat. No. 4,588,439 wherein an oxygen addition is added to improve corrosion resistance by reducing the disintegration of the magnet in humid high-temperature conditions. A. Kim, and J. Jacobson: IEEE Trans on Mag. Mag-23, No. 5, 1987 disclose the addition of aluminum and dysprosium or dysprosium oxide for this purpose. This publication also recognizes that chlorine contamination of the magnet results in deterioration of the corrosion resistance both in humid and in dry air at elevated temperature. Sagawa et al., Japanese Patent No. 63-38555, 1986 disclose the addition of cobalt and aluminum to improve corrosion resistance. These alloying additions are combined with reduced carbon and oxygen contents. Takeshita, and Watanabe: Proceedings of 10th Int'l Workshop on RE magnets and their application (I), Kyoto, Japan, 1989 disclose the addition of oxides of chromium, yttrium, vanadium and aluminum for purposes of corrosion resistance in these alloys. H. Nakamura, A. Fukumo and Yoneyaaama: Proceedings of 10th Int'l Workshop on RE Magnets and Their Application (II) Kyoto, Japan, 1989, discloses the substitution of a portion of iron with cobalt and zirconium for this purpose. A. Hasabe, E. Otsuki and Y. Umetsu: Proceedings of the 10th Int'l Workshop on RE Magnets and their Application (II), Kyoto, Japan, 1989, disclose various anodic polarization techniques for improving corrosion resistance.

All of these practices may result in improved corrosion resistance but otherwise provide problems, such as increased cost or degradation of magnetic properties. For example, the addition of cobalt increases the Curie temperature but causes a decrease in coercive force. The addition of the aforementioned oxides degrades the energy product of the magnets.

SUMMARY OF THE INVENTION

It is accordingly a primary object of the present invention to provide a permanent magnet and a method for producing the same wherein improved corrosion resistance may be achieved while minimizing adverse effects, such as degradation of the magnetic properties and increased cost.

In accordance with the invention there is provided a permanent magnet having improved corrosion resistance, which magnet consists essentially of $Nd_2$-$Fe_{14}$-B with oxygen being equal to or greater than 0.6 weight %, carbon 0.05 to 0.15 weight % and nitrogen 0.15 weight % maximum. Preferably, oxygen may be 0.6 to 1.2 weight %, carbon 0.05 to 0.1 weight % and nitrogen 0.02 to 0.15 or more preferably 0.04 to 0.08 weight %.

In accordance with the method of the invention the aforementioned magnet compositions may be heated in an argon atmosphere and thereafter quenched in a nitrogen atmosphere to further improve the corrosion resistance thereof. The heating in the argon atmosphere may be conducted at a temperature of about 550° C.

All percentages are in weight percent unless otherwise indicated.

DESCRIPTION OF THE PREFERRED EMBODIMENTS

Figure 1:
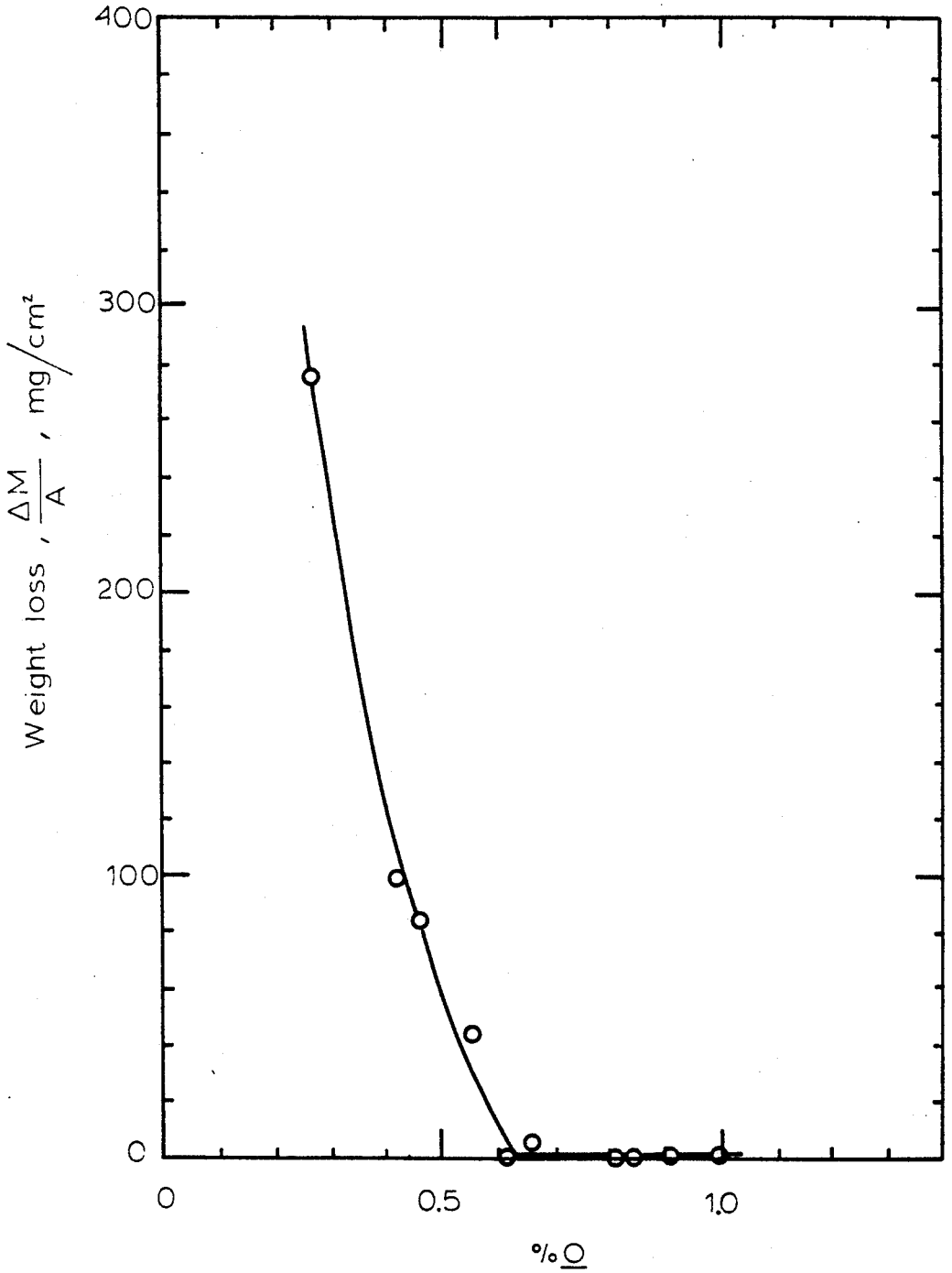
FIG. 1 is a graph showing the weight loss of Fe-33.5% Nd-1.1% B-0.1% C-(0.05 to 0.15%)N magnets made from atomized powder after exposure in an autoclave at 5–10 psi for 96 hours, as a function of the oxygen content of the magnet samples.

To demonstrate the invention permanent magnet alloys and magnets made therefrom were produced by conventional powder metallurgy techniques. The permanent magnet alloy from which the magnet samples were produced contained one or more of the rare earth elements, Nd and Dy, in combination with iron and boron.

The material was produced by vacuum induction melting of a pre-alloyed charge to produce a molten mass of the desired permanent magnet alloy composition. The molten mass was either poured into a mold or atomized to form fine powder by the use of argon gas. The alloy RNA-1 was atomized with a mixture of argon and nitrogen gas. With the molten material poured into a mold, the resulting solidified ingot casting was crushed and pulverized to form coarse powders. These powders, as well as the atomized powders, were ground to form fine powder by jet milling. The average particle sizes of these milled powders were in the range 1 to 4 microns.

The oxygen content of the alloys was controlled by introducing a controlled amount of air during jet milling or alternately blending the powders in air after the milling operation. The nitrogen content was usually controlled by introducing a controlled amount of nitrogen during jet milling, but nitrogen was also introduced during atomization. The latter practice usually produced a high nitrogen content alloy. With high nitrogen content alloys, the nitrogen content was controlled by blending low and high nitrogen alloy powders. This practice was used to produce the samples reported in Table 11 hereinafter. The carbon content was controlled by introducing a controlled amount of carbon into the alloys during melting and/or by blending high carbon alloy powder and low carbon alloy powder to achieve the desired carbon content.

The alloy powders were placed in a rubber bag, aligned in a magnetic field and compacted by cold isostatic pressing. The specific alloy compositions used in the experimental work reported herein are listed in Table 1.

TABLE 1

Chemical compositions of the alloys used in this study.

| | | Composition (wt. %) | | | | | |
|---|---|---|---|---|---|---|---|
| | | Fe | Nd | B | C | N | TRE |
| Alloy 3 | (A) | 64.35 | 34.0 | 1.15 | −0.06 | | |
| Alloy 3C-1 | (C) | Bal | 33.7 | 1.15 | 0.15 | | 34.0 |
| Alloy 3C-2 | (C) | Bal | 33.7 | 1.15 | 0.15 | | 34.0 |
| Alloy 3C-3 | (A) | Bal | 33.5 | 1.10 | 0.10 | | 34.0 |
| RNA-1 | (A) | 63.9 | 34.5 | 1.0 | −0.06 | 0.40 | 35.1 |
| CRNB-1 | (C) | Bal | 32.7 | 1.1 | 0.01 | | 33.2 |
| CRNB-4 | (C) | Bal | 32.3 | 1.12 | 0.06 | | 32.9 |

(A) denotes the atomized powder
(C) denotes the cast ingot

The cold pressed compacts were sintered to substantially full theoretical density in a vacuum furnace at a temperature of 1030° C. for one hour. A portion of the sintered or sintered plus heat treated magnet was then ground to a desired shape. Some of the ground magnets were further heat treated in various environments at different temperatures, as well as being subjected to surface treatment, such as with chromic acid.

The samples were tested with respect to corrosion behavior using an autoclave operated at 5–10 psi in a steam environment at a temperature of 110°–115° C. for 18, 40 or 96 hours. After autoclave testing, the weight loss of the samples was measured with a balance after removing the corrosion products therefrom. The weight loss per unit area of the sample was plotted as a function of the oxygen, nitrogen or carbon content. The contents of oxygen, nitrogen and carbon in the magnet were analyzed with a Leco oxygen-nitrogen analyzer and carbon-sulfur analyzer. The corrosion product was identified by the use of X-ray diffraction.

It has been determined from the work reported herein that the corrosion rate of Nd-Fe-B magnets is affected by the oxygen, carbon and nitrogen contents of the magnet alloy composition and the heat treatment cycle of the magnet.

Figure 2:
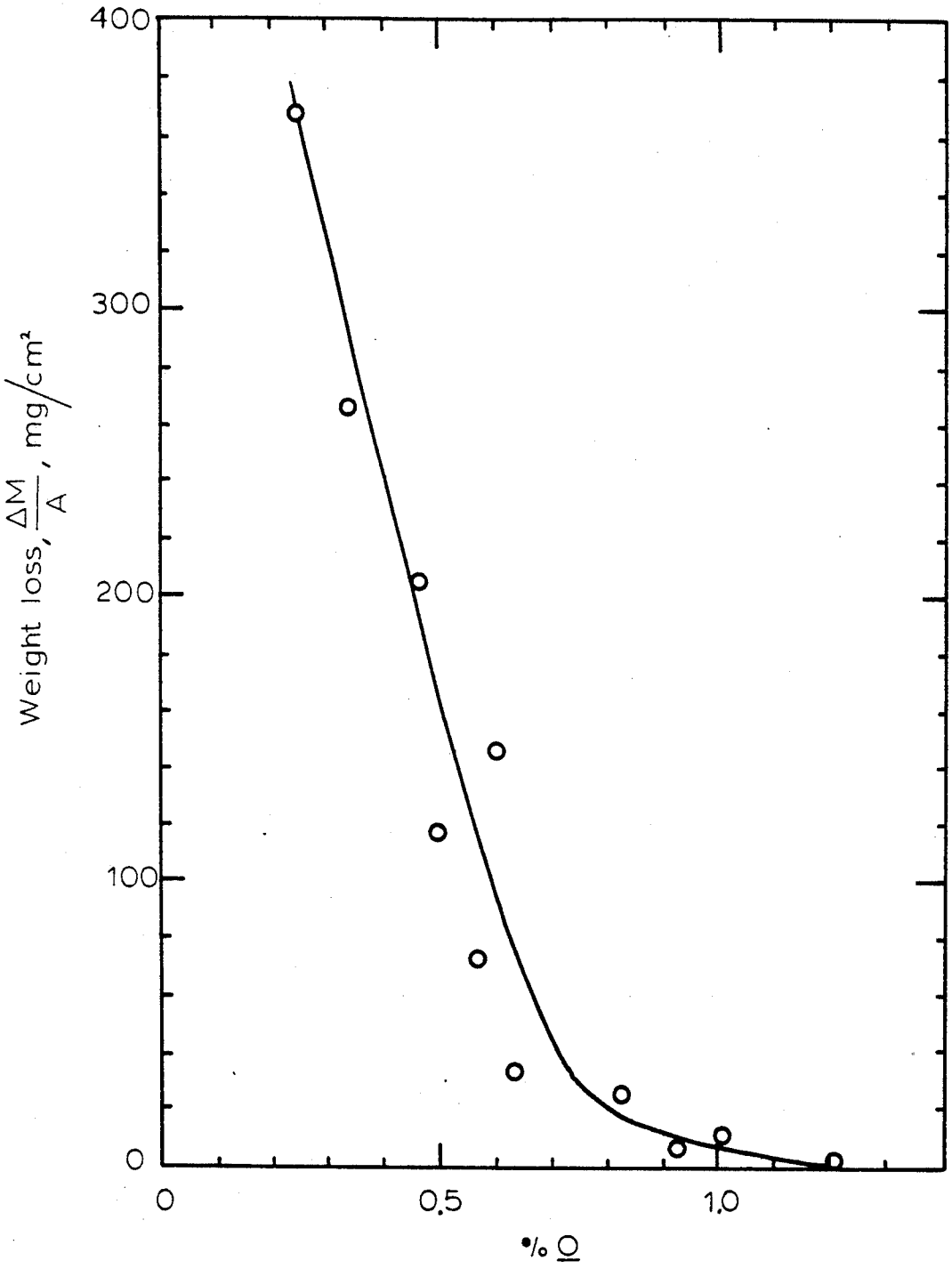
FIG. 2 is a similar graph showing the weight loss of a magnet of the same composition as FIG. 1, except having 0.014 to 0.025% N, after 96 hours exposure in an autoclave at 5–10 psi, as a function of the oxygen content.
Figure 3:
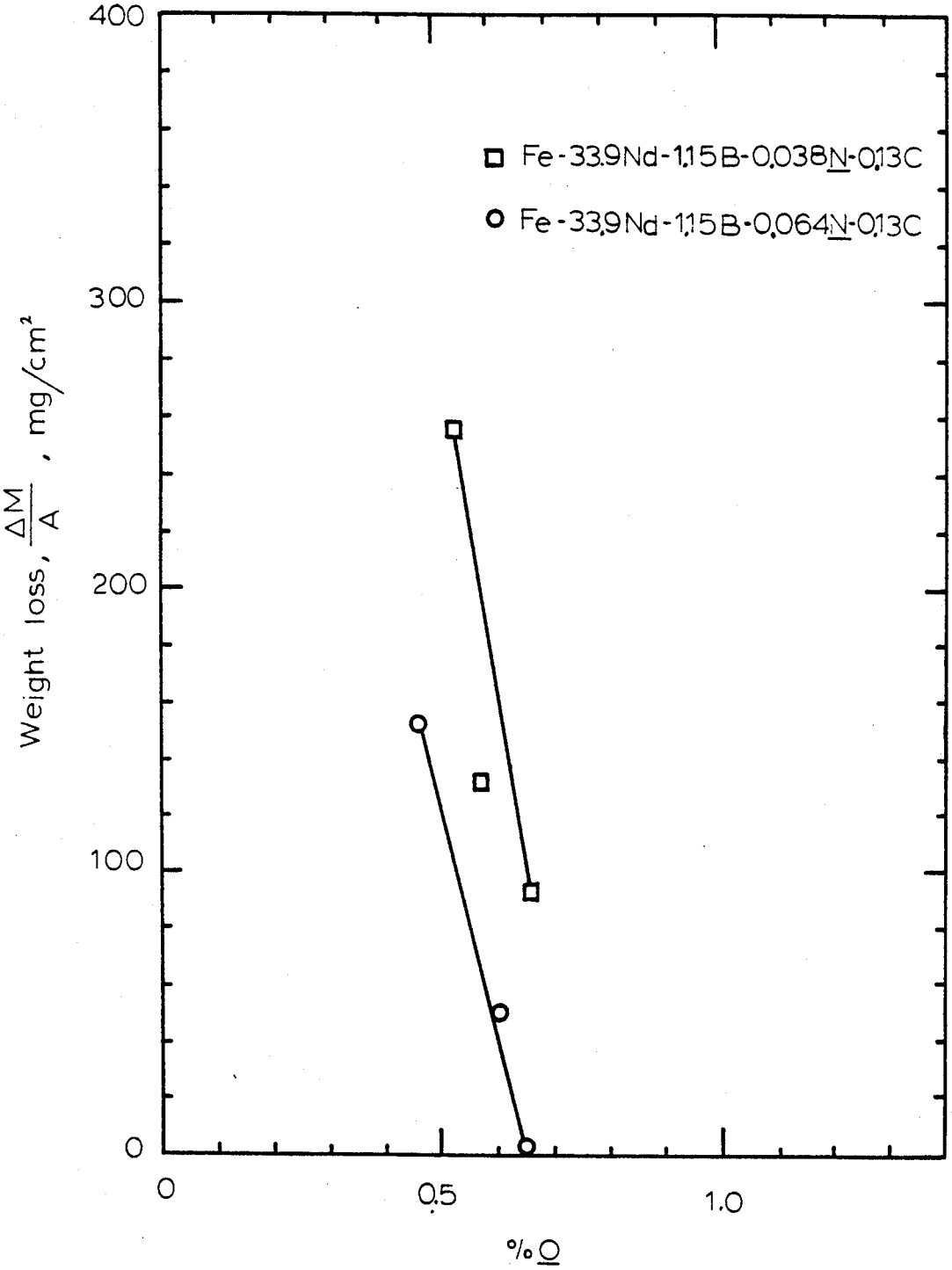
FIG. 3 is a similar graph showing the weight loss after 96 hours exposure in an autoclave at 5–10 psi as a function of the oxygen content of magnets having the compositions in weight percent listed on this figure.

FIGS. 1-3 and Tables 2-5 report the weight loss for the reported magnet compositions after exposure in an autoclave at 5–10 psi within the temperature range of 110°–115° C. for 40 and 96 hours, as a function of the oxygen content. The weight loss of the magnet was measured per unit area of the sample during autoclave testing to provide an indication of the corrosion rate of the magnet in the autoclave environment. As shown in FIG. 1 and Table 2, the corrosion rate of the magnet decreases rapidly as the oxygen content increases from 0.2 to about 0.6%, and reaches a minimum when the oxygen content is between 0.6 and 1.0%. With the minimum corrosion rate, the weight loss is less than 1 $mg/cm^2$ and the corrosion products are barely observable on the surface of the magnet sample after exposure in the autoclave environment for the test period. The oxygen content required to achieve the minimum corrosion rate varies depending upon the carbon and nitrogen contents with the corrosion rate decreasing rapidly as the oxygen content increases up to about 0.6%. As shown in FIG. 2 and Table 3, the corrosion rate of the reported alloy also decreases rapidly with oxygen content increases from 0.2 to 0.6% and reaches the minimum at an oxygen content of 1.2%. In this regard as may be seen from FIGS. 1 and 2, the beneficial affect of oxygen on the corrosion rate shifts from a relatively high oxygen content of about 1.0% to a relatively low oxygen content of about 0.6% as the nitrogen content is varied from a range of 0.014–0.025% to 0.05–0.15% with a carbon content of 0.1%. Hence, at these oxygen and carbon contents, the corrosion rate decreases as the nitrogen content increases from about 0.02% to between 0.05 to 0.15%. This data shows the significance of nitrogen and that nitrogen is beneficial in improving corrosion resistance within the oxygen content limits of the invention, including the preferred oxygen limit of 0.6 to 1.2%.

TABLE 2

Weight loss of Fe-33.5 Nd-1.1 B-0.1 C-(0.05–0.15)N magnets made from atomized powder after exposure in autoclave at 5–10 psi for 40 and 96 hours, respectively, as a function of O, N, and C contents

| Composition | | | Weight Loss (mg/cm²) | | | |
|---|---|---|---|---|---|---|
| | | | Ground | | H.T. → $N_2$Q | |
| O | N | C | 40 Hrs | 96 Hrs | 40 Hrs | 96 Hrs |
| 0.27 | 0.055 | 0.087 | 55.8 | 276 | 40.9 | 130 |
| 0.43 | 0.079 | 0.10 | 41.9 | 99 | 13.3 | 96.8 |
| 0.47 | 0.057 | 0.093 | 12.5 | 83.6 | 3.7 | 47.0 |
| 0.56 | 0.11 | 0.115 | 0.94 | 43.8 | 0.98 | 6.07 |
| 0.625 | 0.145 | 0.10 | 0.35 | 0.33 | 0.45 | 1.24 |
| 0.665 | 0.084 | 0.10 | 0.79 | 3.72 | 0.24 | 2.57 |
| 0.815 | 0.11 | 0.093 | 0.34 | 0.42 | 1.05 | 0.45 |
| 0.85 | 0.14 | 0.10 | 0.18 | 0.07 | 0.46 | 0.07 |
| 0.85 | 0.15 | 0.10 | 0.84 | 0.05 | 0.82 | 0.77 |
| 0.915 | 0.11 | 0.093 | 0.38 | 0.35 | 0.50 | 0.22 |
| 0.995 | 0.13 | 0.086 | 0.65 | 1.72 | 0.55 | 1.35 |

TABLE 3

Weight loss of Fe-33.5 Nd-1.1 B-0.1 C-(0.014–0.025)N magnets made from atomized powder after exposure in autoclave at 5–10 psi for 40 and 96 hours, respectively, as a function of O, and N contents

| Composition (wt. %) | | | Weight Loss (mg/cm²) | | | |
|---|---|---|---|---|---|---|
| | | | Ground | | H.T. → $N_2$Q | |
| O | N | C | 40 Hrs | 96 Hrs | 40 Hrs | 96 Hrs |
| 0.245 | 0.015 | 0.10 | 92.9 | 368 | 63.8 | 368 |
| 0.340 | 0.022 | 0.10 | 35.6 | 266 | 1.52 | 224 |
| 0.46 | 0.015 | 0.10 | 23.2 | 204 | 10.4 | 146 |
| 0.50 | 0.015 | 0.10 | 12.8 | 116 | 1.5 | 105 |
| 0.57 | 0.022 | 0.10 | 3.85 | 72.3 | 0.81 | 70.9 |
| 0.60 | 0.015 | 0.10 | 13.1 | 145 | 6.1 | 128 |
| 0.63 | 0.015 | 0.10 | 14.5 | 32.8 | 2.8 | 36.5 |
| 0.825 | 0.014 | 0.10 | 2.43 | 25.0 | 0.9 | 17.3 |
| 0.92 | 0.014 | 0.10 | 0.39 | 6.92 | 0.85 | 4.3 |
| 1.2 | 0.014 | 0.10 | 0.15 | 1.13 | 0.7 | 0.8 |

The corrosion rates of the identical alloy composition used in obtaining the data reported in FIGS. 1 and 2 except with varying nitrogen contents were compared as a function of the oxygen content. As shown in FIG. 3 and Table 4, the corrosion rates of both magnets having low nitrogen (0.038%) and with higher nitrogen (0.064%) decreased rapidly as the oxygen content increased. It may be seen, however, that the corrosion rate progresses downwardly as the nitrogen content increases from 0.038 to 0.064% at the reported range of oxygen content with a carbon content of 0.13%.

TABLE 4

Weight loss of ground Fe-33.9 Nd-1.15 B magnets made from mixed powder after autoclave test at 5–10 psi as a function of O, N and C contents.

| Composition | | | Weight Loss (mg/cm²) | | |
|---|---|---|---|---|---|
| O | N | C | 18 Hr | 40 Hr | 96 Hr |
| 0.46 | 0.068 | 0.14 | 4.4 | 69.2 | 153 |
| 0.60 | 0.064 | 0.14 | 1.1 | 15.1 | 51 |
| 0.65 | 0.064 | 0.13 | 0.2 | 2.5 | 1.7 |
| 0.52 | 0.037 | 0.13 | 1.2 | 75.5 | 256 |
| 0.57 | 0.038 | 0.13 | 1.4 | 92.4 | 132 |
| 0.66 | 0.039 | 0.13 | 0.7 | 30.7 | 93 |

Table 5 shows the corrosion rate of the reported alloy composition as a function of the oxygen content. The corrosion rate decreases as the oxygen content increases. It is noted, however, that the corrosion of this alloy is higher than that of the alloy Fe-33.9Nd-1.15B-0.064N-0.14C alloy shown in Table 4 at a similar oxygen content range. This indicates that the corrosion rate is also affected by the carbon content. From these results, it may be seen that the corrosion rate is affected not only by the oxygen content but also by the carbon and nitrogen contents.

TABLE 5

Weight loss of ground Fe-34 Nd-1.15 B magnets made from atomized powder after autoclave test at 5–10 psi as a function of O, N, and C content.

| Composition | | | Weight Loss (mg/cm²) | | |
|---|---|---|---|---|---|
| O | N | C | 18 Hr | 40 Hr | 96 Hr |
| 0.3 | 0.054 | 0.057 | 23.0 | 57.8 | 395 |
| 0.56 | 0.052 | 0.065 | 1.8 | 38.7 | 207 |
| 0.57 | 0.051 | 0.061 | 4.6 | 59.7 | 191 |

Figure 4:
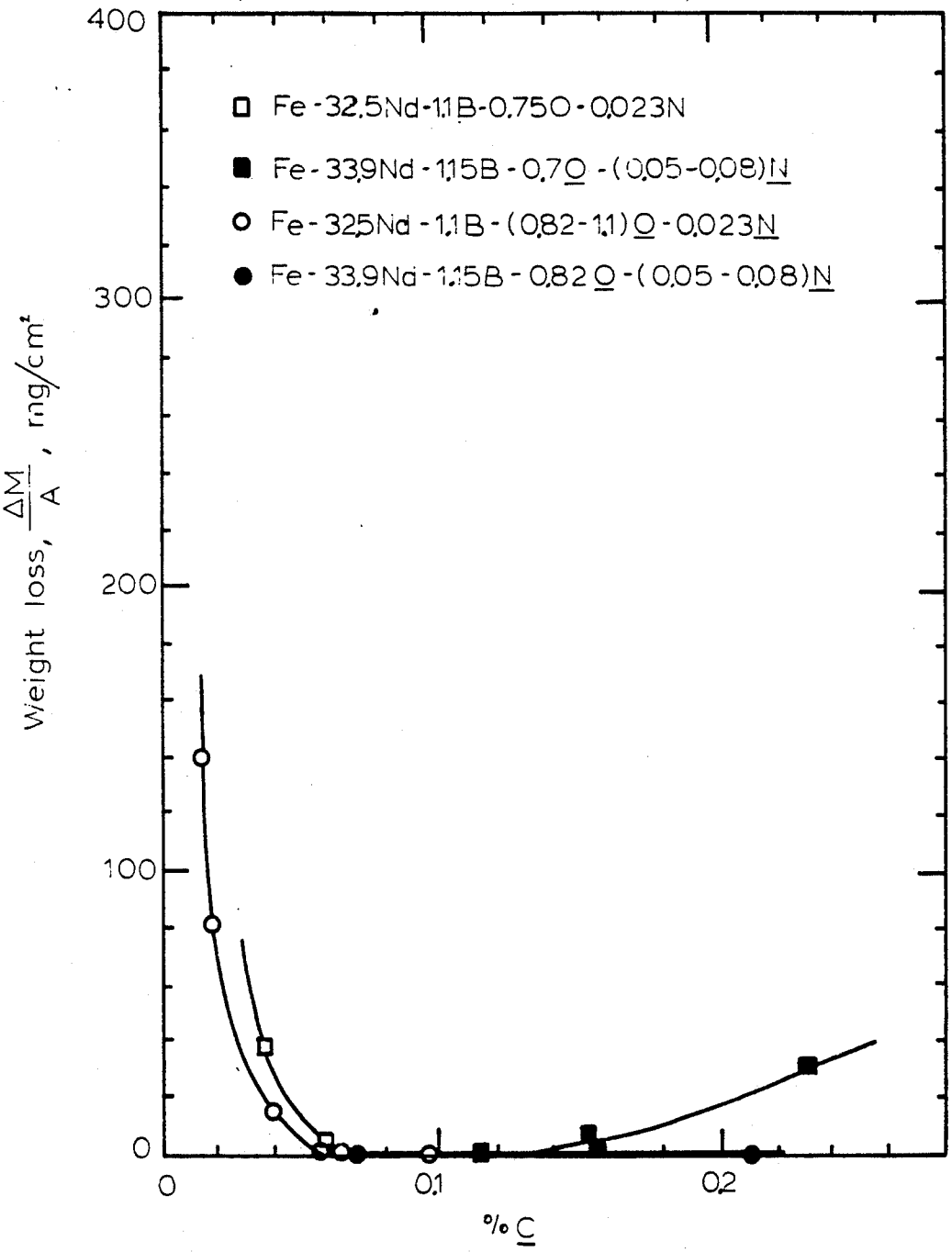
FIG. 4 is a similar graph showing weight loss after exposure in an autoclave at 5–10 psi as a function of carbon content of magnets having the compositions in weight percent listed on this figure.
Figure 5:
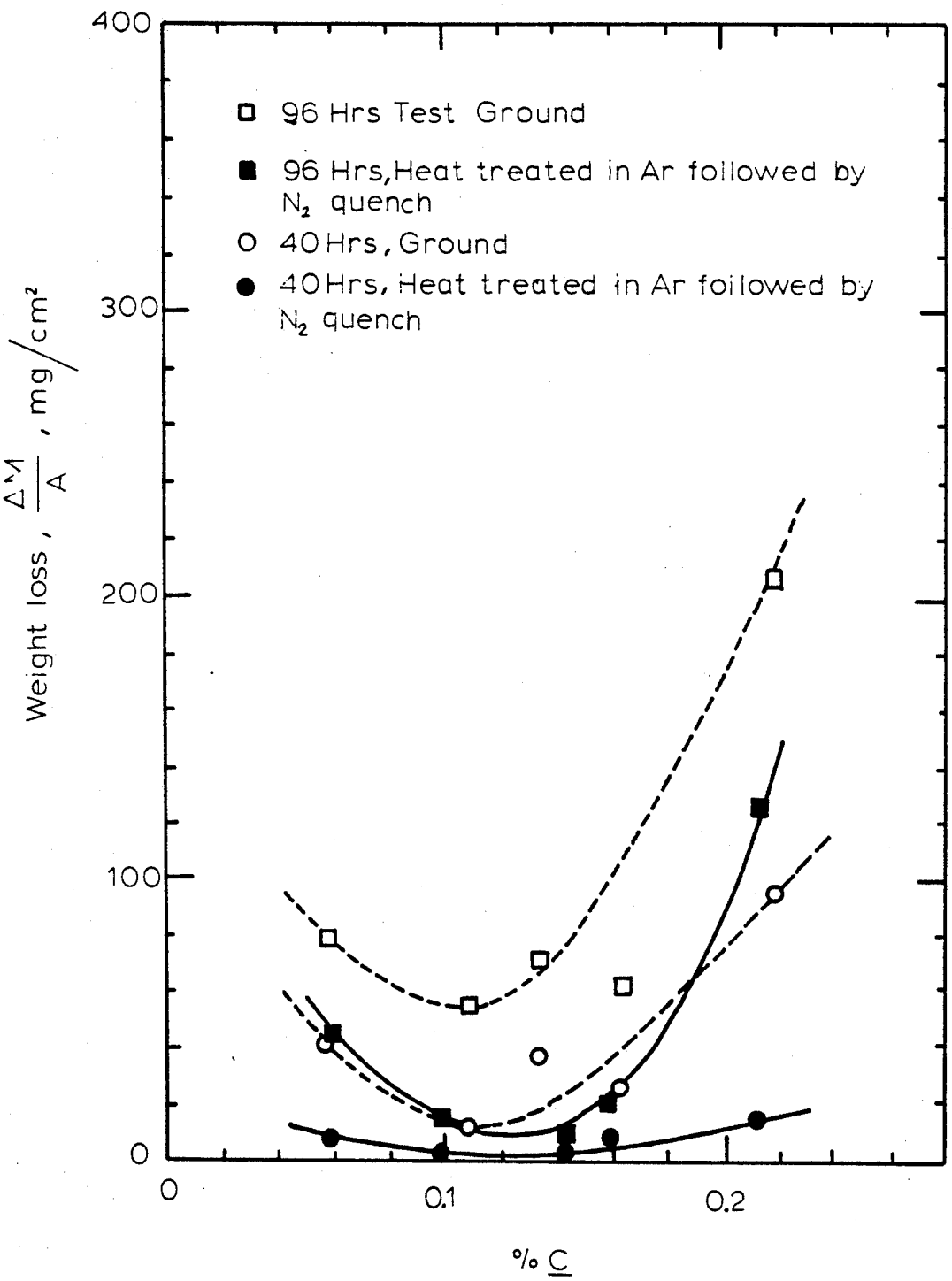
FIG. 5 is a similar graph showing the weight loss of Fe-33.9% Nd-1.15% B-0.46% O-0.055% N magnets after exposure in an autoclave at 5–10 psi as a function of carbon content, exposure time and surface treatment.
Figure 6:
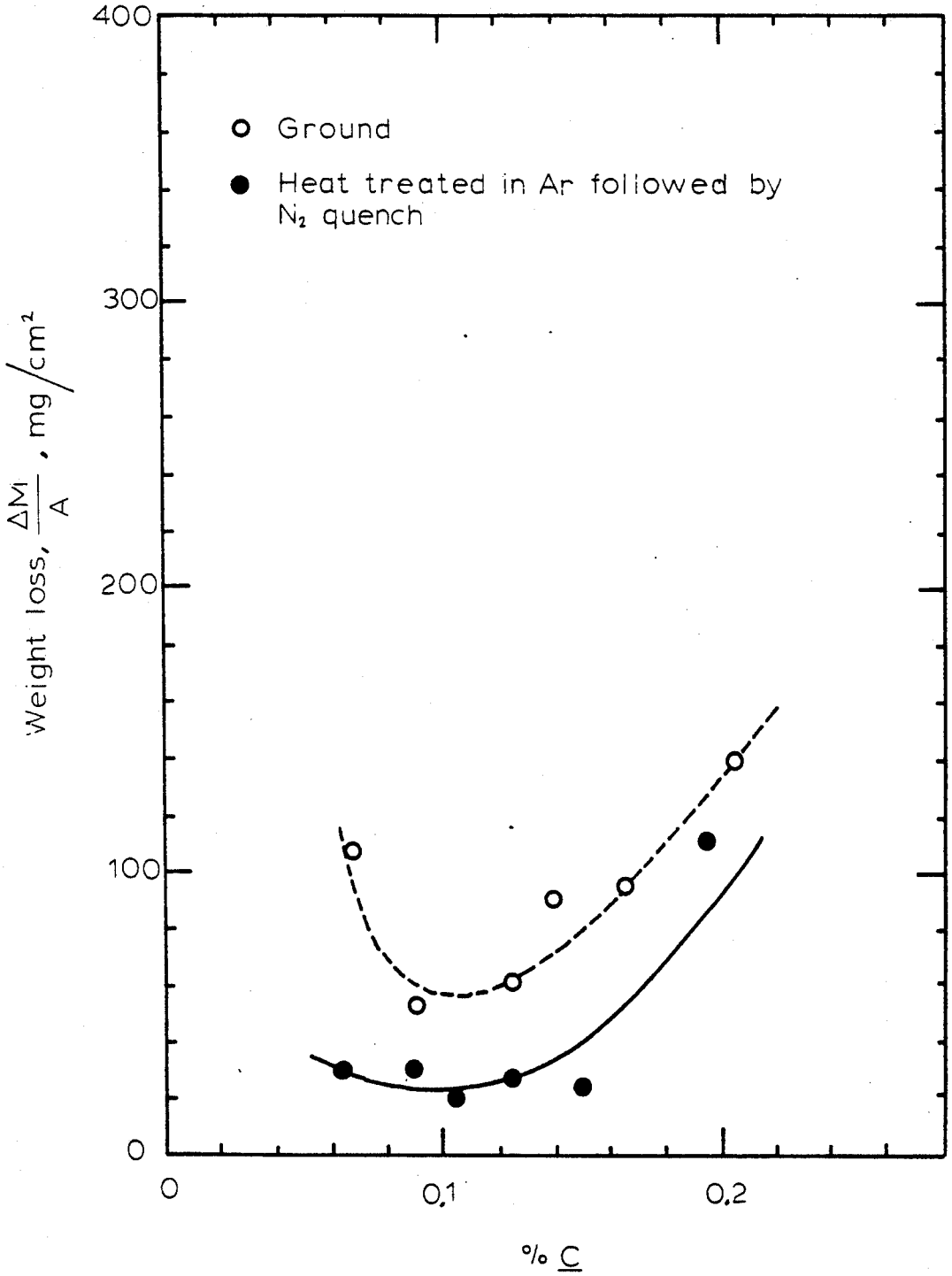
FIG. 6 is a similar graph showing weight loss of Fe-33.9% Nd-1.15% B-0.33% O-0.024% N magnets after autoclave testing for 40 hours at 5–10 psi as a function of the carbon content and surface treatment.

FIGS. 4–6 and Tables 6–9 show the weight loss of Nd-Fe-B magnets after exposure in an autoclave environment at 5–10 psi at a temperature of 110°–115° C. as a function of the carbon content.

TABLE 6

Weight loss of Fe-33.9 Ni-1.15 B magnets made from mixed powder after exposure in autoclave test at 5–10 psi as a function of O, N, and C contents and surface treatment.

| Composition | | | | | Weight Loss After Autoclave Test | | | |
|---|---|---|---|---|---|---|---|---|
| | | | | | Ground | | H.T. → $N_2$Q | |
| Nd | B | O | N | C | 40 Hrs | 96 Hrs | 40 Hrs | 96 Hrs |
| 33.9 | 1.15 | 0.71 | 0.072 | 0.11 | 0.4 | 0.3 | 0.4 | 0.6 |
| 33.9 | 1.15 | 0.68 | 0.064 | 0.15 | 0.1 | 7.5 | 0.1 | 2.0 |
| 33.9 | 1.15 | 0.70 | 0.066 | 0.15 | 1.7 | 0.1 | 0.7 | 0.1 |
| 33.9 | 1.15 | 0.72 | 0.056 | 0.23 | 6.4 | 29.5 | 0.8 | 15.3 |
| 34.0 | 1.15 | 0.82 | 0.080 | 0.068 | 1.3 | 0.2 | 1.1 | 0.1 |
| 33.9 | 1.15 | 0.82 | 0.075 | 0.11 | 1.3 | 0.4 | 0.8 | 0.4 |
| 33.7 | 1.15 | 0.82 | 0.056 | 0.21 | 0.1 | 0.1 | 0.1 | 0.1 |

TABLE 7

Weight loss of ground Fe-32.5 Nd-1.1 B magnets made from cast ingot after autoclave test at 5–10 psi as a function of O, N, and C contents.

| Composition | | | | | Weight Loss (mg/cm²) | |
|---|---|---|---|---|---|---|
| Nd | B | O | N | C | 40 Hr | 96 Hr |
| 32.5 | 1.1 | 0.75 | 0.022 | 0.034 | 9.7 | 39.4 |
| 32.3 | 1.1 | 0.75 | 0.023 | 0.056 | 0.57 | 4.83 |
| 32.7 | 1.1 | 0.865 | 0.021 | 0.014 | 31.8 | 142 |
| 32.7 | 1.1 | 0.93 | 0.023 | 0.017 | 20.3 | 81.5 |
| 32.5 | 1.1 | 0.87 | 0.021 | 0.038 | 2.7 | 15.4 |
| 32.3 | 1.1 | 0.82 | 0.024 | 0.055 | 1.09 | 0.49 |
| 32.3 | 1.1 | 1.1 | 0.024 | 0.062 | 2.65 | 0.22 |

TABLE 7-continued

Weight loss of ground Fe-32.5 Nd-1.1 B magnets made from cast ingot after autoclave test at 5-10 psi as a function of O, N, and C contents.

| Composition | | | | | Weight Loss ($mg/cm^2$) | |
|---|---|---|---|---|---|---|
| Nd | B | O | N | C | 40 Hr | 96 Hr |
| 32.6 | 1.1 | 1.05 | 0.033 | 0.0935 | 0.07 | 0.29 |

TABLE 8

Weight loss of Fe-33.9 Nd-1.15 B-0.46 O-0.055 N magnets made from mixed powder after autoclave test at 5-10 psi as a function of C contents and surface treatment.

| Composition | | | | | Weight Loss ($mg/cm^2$) | | | | | |
|---|---|---|---|---|---|---|---|---|---|---|
| | | | | | Ground | | | H.T. → $N_2O$ | | |
| | | | | | 18 | 40 | 96 | 18 | 40 | 96 |
| Nd | B | O | N | C | Hr | Hr | Hr | Hr | Hr | Hr |
| 34.0 | 1.15 | 0.47 | 0.053 | 0.059 | 4.5 | 41.3 | 78.8 | 0.12 | 7.2 | 46.3 |
| 33.9 | 1.15 | 0.52 | 0.052 | 0.105 | 3.9 | 11.8 | 54.8 | 0.15 | 2.1 | 16.0 |
| 33.9 | 1.15 | 0.46 | 0.055 | 0.140 | 1.2 | 38.8 | 71.6 | 0.21 | 2.9 | 10.3 |
| 33.8 | 1.15 | 0.46 | 0.056 | 0.160 | 4.2 | 25.5 | 62.6 | 1.2 | 9.1 | 19.4 |
| 33.7 | 1.15 | 0.45 | 0.058 | 0.22 | 20.7 | 95.8 | 207 | 0.52 | 15.9 | 127 |

TABLE 9

Weight loss of Fe-33.9 Nd-1.15 B-0.33 O-0.024 N magnets made from mixed powder after autoclave test at 5-10 psi as a function of C content and surface treatment.

| Composition | | | | | Weight Loss ($mg/cm^2$) | | | | | |
|---|---|---|---|---|---|---|---|---|---|---|
| | | | | | Ground | | H.T. | | $H_2CrO_4$ | |
| | | | | | 18 | 40 | 18 | 40 | 18 | 40 |
| Nd | B | O | N | C | hr | hr | Hr | Hr | Hr | Hr |
| 34.0 | 1.15 | 0.38 | 0.029 | 0.065 | 3.7 | 106 | 0.9 | 29 | 0.4 | 28 |
| 33.9 | 1.15 | 0.34 | 0.027 | 0.089 | 0.2 | 53.1 | 0.4 | 29 | 0.2 | 27 |
| 33.9 | 1.15 | 0.32 | 0.025 | 0.110 | 0.1 | 60 | 0.3 | 20 | 0.5 | 29 |
| 33.8 | 1.15 | 0.33 | 0.023 | 0.130 | 5.0 | 91 | 0.2 | 28 | 0.7 | 48 |
| 33.8 | 1.15 | 0.32 | 0.022 | 0.155 | 0.7 | 94 | 0.1 | 23 | 1.3 | 48 |
| 33.7 | 1.15 | 0.29 | 0.019 | 0.200 | 19.6 | 139 | 1.4 | 111 | 1.7 | 112 |

As may be seen from this data, when the oxygen content is greater than 0.6% and the nitrogen content is about 0.025%, the corrosion rate of the magnet decreases rapidly as the carbon content is increased up to about 0.05% and then reaches the minimum corrosion rate at about 0.06% carbon, as shown in FIG. 4 and Table 6 and 7. When the oxygen content is greater than 0.6%, the nitrogen content is 0.05-0.08% and the carbon content is within the range of 0.06-0.15%, the corrosion rate is at the minimum level. If the oxygen content is about 0.7%, and the carbon content exceeds 0.15%, the corrosion rate begins to increase. If the oxygen content is greater than 0.8%, then the minimum corrosion rate continues until the carbon content reaches about 0.2%. This data indicates that carbon is an important element in affecting the corrosion rate even in the presence of relatively high oxygen contents. The significant carbon content for the minimum corrosion rate is about 0.05%, and the maximum carbon content for the minimum corrosion rate is about 0.15%. Therefore, when the oxygen content is in the range 0.6-1.2%, this carbon range results in the minimum corrosion rate.

FIG. 5 and Table 8 show that the corrosion rates of Nd-Fe-B magnets containing 0.46% oxygen and 0.055% nitrogen decreases to their lowest levels when the carbon content is increased up to about 0.11% and then rises with further increases in the carbon content.

It is noted that although the corrosion rate decreases to its lowest level when the carbon content is within the above-stated range of the invention, the corrosion rate is still relatively high with an oxygen content of 0.46%, which is lower than the 0.6% lower limit for oxygen in accordance with the invention. This indicates that carbon reduces the corrosion rate but does not achieve this alone but only in combination with oxygen within the limits of the invention. Therefore, the minimum corrosion rate can be obtained by controlling both oxygen and carbon, as shown in FIG. 4.

Further reduction in the oxygen content as well as in the nitrogen content increases the overall corrosion rate, as shown in FIG. 6 and Table 9. The corrosion rate of Nd-Fe-B magnet containing 0.33% oxygen and 0.024% nitrogen decreases to its lowest value when the carbon content is increased up to about 0.1% and then increases with further increases in the carbon content. The corrosion rate of this magnet as a function of the carbon content exhibits a much higher corrosion rate than that of the magnet containing higher oxygen. This indicates that the magnet containing relatively low oxygen is much more easily oxidized. From this data, it was determined that the carbon content to achieve desired low corrosion rates is within the range of 0.05-0.15%.

Figure 7:
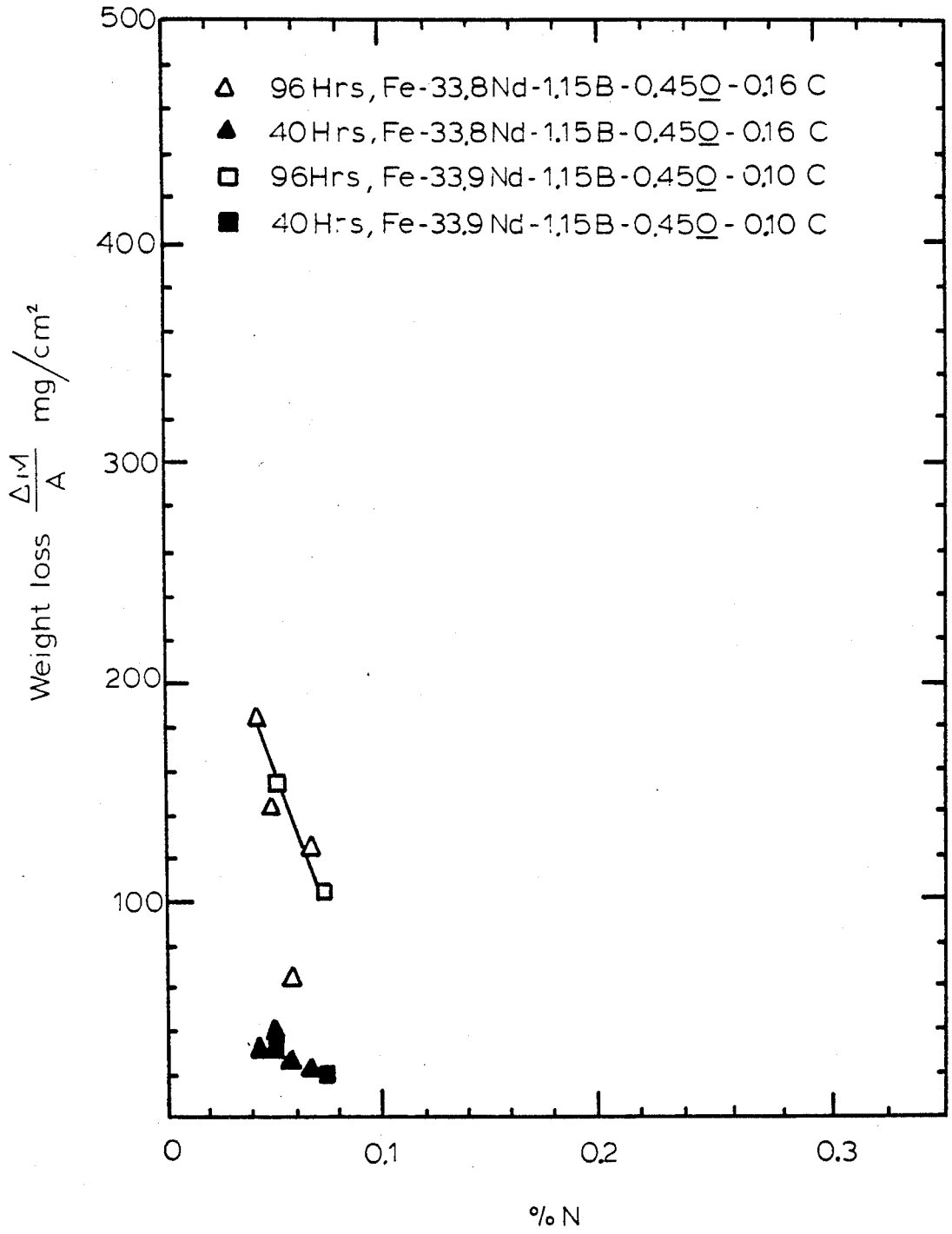
FIG. 7 is a similar graph showing weight loss of Fe-Nd-B-0.45% O-0.10 to 0.16% C magnets after exposure in an autoclave for 40 hours and 96 hours at 5–10 psi as a function of the nitrogen content.
Figure 8:
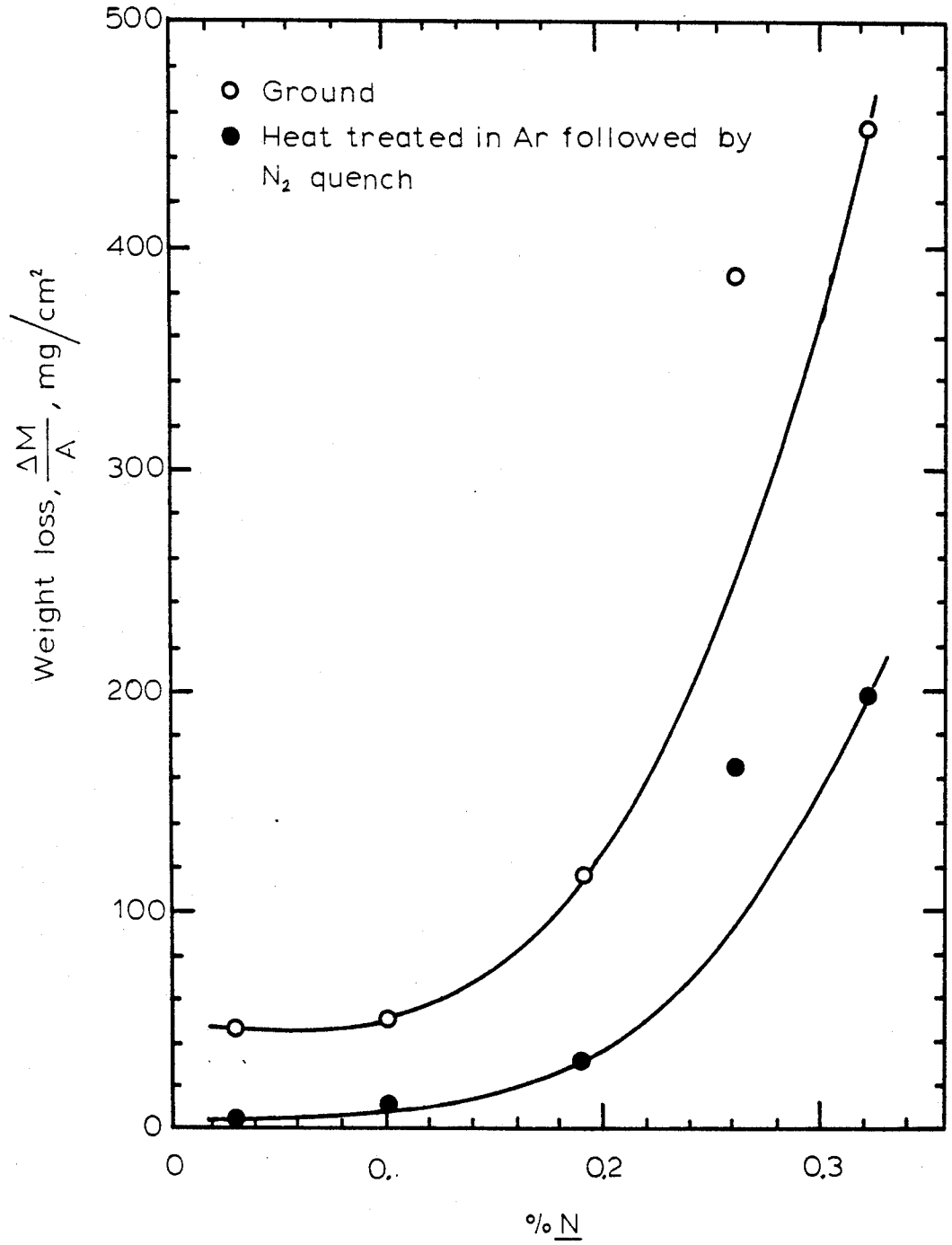
FIG. 8 is a similar graph showing weight loss of Fe-34.2% Nd-1.13% B-0.55% O-0.06% C magnets after exposure in an autoclave for 40 hours at 5–10 psi as a function of nitrogen content.

FIGS. 7 and 8 and Tables 10 and 11 show the weight loss of Nd-Fe-B magnets after exposure in an autoclave environment at 5-10 psi at a temperature of 110°-115° C. as a function of the nitrogen content.

TABLE 10

Weight loss of Nd—Fe—B magnets made from mixed powder after exposure in autoclave at 5-10 psi for 40 and 96 hours, respectively, as a function of N content.

| Composition | | | | | Weight Loss ($mg/cm^2$) | | | |
|---|---|---|---|---|---|---|---|---|
| | | | | | Ground | | H.T. → $N_2O$ | |
| Nd | B | O | N | C | 40 Hrs | 96 Hrs | 40 Hrs | 96 Hrs |
| 33.8 | 1.15 | 0.44 | 0.041 | 0.16 | 32.3 | 183 | 11.3 | 100 |
| 33.8 | 1.15 | 0.44 | 0.048 | 0.16 | 40.5 | 142 | 5.7 | 97 |
| 33.8 | 1.15 | 0.46 | 0.056 | 0.16 | 25.5 | 62.6 | 9.1 | 19.4 |
| 33.8 | 1.15 | 0.46 | 0.065 | 0.16 | 22.0 | 124 | 3.9 | 76.3 |
| 33.9 | 1.15 | 0.45 | 0.049 | 0.10 | 31.5 | 154 | 4.6 | 132 |
| 33.9 | 1.15 | 0.44 | 0.071 | 0.10 | 20.2 | 103 | 1.8 | 77.6 |

TABLE 11

Weight loss of Fe-34.2 Nd-1.13 B-0.56 O-0.06 C magnets made from atomized powder after 40 hr autoclave test at 5-10 psi as a function of N content and surface treatment.

| Composition | | | | | | Weight Loss ($mg/cm^2$) | |
|---|---|---|---|---|---|---|---|
| | | | | | | H.T. Ar- | H.T. Vac- |
| Nd | B | O | N | C | Ground | $N_2O$ | ArO |
| 34.0 | 1.15 | 0.43 | 0.027 | 0.065 | 45.8 | 3.5 | 12.6 |
| 34.1 | 1.14 | 0.52 | 0.105 | 0.062 | 52.1 | 11.2 | 24 |
| 34.2 | 1.13 | 0.54 | 0.185 | 0.060 | 116 | 31.4 | 40 |
| 34.3 | 1.12 | 0.62 | 0.26 | 0.057 | 385 | 166 | 104 |
| 34.4 | 1.11 | 0.69 | 0.34 | 0.057 | 454 | 198 | 112 |

As shown in FIG. 7, when the carbon content is relatively high (0.10-0.16% C), the corrosion rate decreases as the nitrogen content increases from about 0.04 to about 0.07%. Similar behavior was also observed with respect to the data reported in FIGS. 1 and 2. When the nitrogen content increases from 0.014-0.025% to 0.05-0.15% in the Fe-33.5Nd-1.1B-0.1C alloy, the corrosion rate decreases substantially at a similar oxygen content. When, however, the carbon content is relatively low (about 0.06%), the effect of the nitrogen content on the corrosion rate is adverse. FIG. 8 and Table 11 show the weight loss of the reported magnets made from blends of nitrogen atomized powder (RNA-1) and argon atomized powder (Alloy 3), as a function of the nitrogen content. Since the nitrogen atomized powder (RNA-1) contains a high nitrogen content (0.4%), a low nitrogen content alloy powder (Alloy 3) was blended in a proper ratio to control the nitrogen content of the alloy. As shown in FIG. 8, the corrosion rate of low carbon content alloys increases slowly up to 0.1% nitrogen and then increases with further increases in the nitrogen content. Therefore, a high nitrogen content exceeding 0.15% nitrogen is detrimental to the corrosion resistance of low carbon Nd-Fe-B magnets with nitrogen contents being beneficial within the range of 0.05–0.15% with carbon contents within the range of the invention. This data indicates that the carbon and nitrogen contents may adversely affect the corrosion resistance imparted by each if they are not each within the limits of the invention. This data also shows that the corrosion rate reaches a minimum even though the nitrogen content is as low as 0.025% when the oxygen and carbon contents are within the limits of the invention, as shown in Table 7 and FIG. 4. From these results, the proper nitrogen content for a minimum corrosion rate is 0.15% maximum, preferably 0.02–0.15%, and more preferably 0.04–0.08%.

Heat treatment in an argon atmosphere followed by a nitrogen quench substantially reduces the corrosion rate, as shown in FIG. 8.

As shown in FIGS. 5, 6 and 8, magnets heat treated in an argon atmosphere followed by nitrogen quenching exhibit a corrosion rate much lower than untreated magnets. This indicates that the corrosion resistance can be improved by this heat treatment but that the corrosion resistance cannot be improved to the extent achieved within the oxygen, carbon and nitrogen limits in accordance with the invention. The improvement in corrosion resistance achieved through this heat treatment may result from the modification of the magnet surface by forming a protective layer thereon.

Tables 12, 13 and 14 show the weight loss of various Nd-Fe-B magnets after autoclave testing, as a function of the surface treatment or heat treatment.

TABLE 12

Weight loss of 34 Nd-64.9 Fe-1.1 B-0.5 O-0.07 N-0.07 C magnets after autoclave test at 5–10 psi as a function of surface treatment.

| Surface Treatment | Weight Loss ($mg/cm^2$) 24 hr | 48 Hr |
|---|---|---|
| Control | 2.1 | 2.9 |
| 550° C. in Ar—$N_2$ Quench | 0.8 | 0.6 |
| 550° C. in $N_2$— Quench | 2.9 | 10.1 |
| 550° C. in $\frac{1}{3}N_2 + \frac{2}{3}Ar$ $N_2$ Quench | 1.1 | 9.6 |
| 900° C. in Vac - $N_2$ Quench | 4.3 | 3.1 |
| 900° C. in Ar—$N_2$ Quench | 28.6 | 76.6 |
| 900° C. in $\frac{1}{3}N_2 + \frac{2}{3}Ar$ $N_2$ Quench | 11.2 | 7.4 |

TABLE 13

Weight loss of various Nd—Fe—B magnets after 40 hr autoclave test at 5–10 psi as a function of surface treatment.

| Surface Treatment | Weight Loss ($mg/cm^2$) *Alloy 1 | Alloy 2 | Alloy 3 |
|---|---|---|---|
| Control | 23.5 | 23.9 | 49.1 |
| 550° C. in Ar—$N_2$ Quench | 1.2 | 1.8 | 1.4 |
| 550° C. in $1/6N_2 + 5/6Ar - N_2$ Quench | 31.1 | 6.5 | 6.9 |
| 200° C. in Air | 36.8 | 24 | 54.6 |
| 200° C. in $N_2$ | 52.3 | 19.0 | 61.5 |
| 550° C. in Ar—$N_2$.Q → 200° C. | 0.8 | 1.3 | 1.1 |

TABLE 13-continued

Weight loss of various Nd—Fe—B magnets after 40 hr autoclave test at 5–10 psi as a function of surface treatment.

in Air

| * | Nd | Dy | B | Fe |
|---|---|---|---|---|
| Alloy 1 | 32.5 | 1.3 | 1.05 | Bal |
| Alloy 2 | 34.0 | — | 1.15 | Bal |
| Alloy 3 | 30.5 | 3.3 | 1.1 | Bal |

TABLE 14

Weight loss of Fe-30.5 Nd-3.3 Dy-1.1 B magnet after 40 hr autoclave test at 5–10 psi as a function of surface treatment.

| Surface Treatment | Weight Loss ($mg/cm^2$) |
|---|---|
| Control (No H.T.) | 33.4 |
| 550° C. in Ar—Ar Quench | 26.0 |
| 550° C. in $N_2$—$N_2$ Quench | 86.0 |
| 550° C. in Ar-Air Quench | 223 |
| 550° C. in Vac. - Ar Quench | 1.5 |
| 550° C. in $1/6O_2 + 5/6Ar$—Ar Quench | 195 |
| 900° C. in Vac. - Ar Quench | 4.1 |

As shown in Table 12, the magnet heat treated at 550° C. in an argon atmosphere followed by nitrogen quenching exhibited a corrosion rate lower than that of the control sample (a ground and untreated magnet), while magnets heat treated at 550° C. in nitrogen or heated at 900° C. in vacuum, argon or nitrogen exhibited corrosion rates higher than that of the control sample. This data shows that heat treatments other than at about 550° C. in argon followed by nitrogen quenching form a non-protective layer and thus increase the corrosion rate of the magnet. Table 13 also shows the weight loss of various magnets after autoclave testing as a function of heat treatment. As shown in Table 13, heat treatment at 550° C. in argon followed by a nitrogen quench substantially reduces the corrosion rate from that of the control sample, while heat treatment at 550° C. in nitrogen and argon followed by nitrogen quenching increases the corrosion rate. As shown in this table, preheating the sample at 200° C. in air or nitrogen increases the corrosion rate over that of the control sample. However, the magnet heat treated at 550° C. in argon followed by a nitrogen quench exhibits a further decrease in the corrosion rate after heating at 200° C. in air. Improved corrosion resistance is also achieved by heat treating in vacuum at 550° C. followed by argon quenching. As shown in Table 14 a heat treatment in a vacuum at 550° C. or 900° C. substantially reduces the corrosion rate from the control sample, while heat treatments at 550° C. in nitrogen or oxygen containing environments or in argon followed by air quenching increases the corrosion rate significantly. Heat treatment at 550° C. under argon slightly improves the corrosion resistance.

Table 15 shows those phases identified by X-ray diffraction formed on the surface of the magnets after various heat treatments.

TABLE 15

Phases analyzed by x-ray diffraction formed on the surface of the magnet after various heat treatments.

| Heat Treatment | Major Phase | Minor Phases |
|---|---|---|
| Control (as ground) | $Nd_2Fe_{14}B$ | Nd-rich |
| Ar/550° C. → $N_2$ Quench | α-Fe | x (undefined) |
| Vac/550° C. → Ar Quench | α-Fe | $Nd_2Fe_{14}B$, y (undefined) |
| Ar/550° C. → Ar Quench | α-Fe | $Nd_2Fe_{14}B$, FeO |
| $N_2$/550° C. → $N_2$ Quench | $Nd_2Fe_{14}B$ | Nd-rich |

TABLE 15-continued

Phases analyzed by x-ray diffraction formed on the surface of the magnet after various heat treatments.

| Heat Treatment | Major Phase | Minor Phases |
|---|---|---|
| $1/6O_2$ + 5/6Ar/550° C. → Ar Quench | $\alpha$-$Fe_2O_3$ | $\alpha$-Fe |
| Vac./900° C. → Ar Quench | $\alpha$-Fe | $Nd_2O_3$ |
| $\frac{1}{3}N_2$ + $\frac{2}{3}$Ar/900° C. → Ar Quench | $\alpha$-Fe | Nd-rich, $Nd_2Fe_{14}B$ |

Table 16, 17 and 18 show magnetic properties of various Nd-Fe-B magnets as a function of the carbon, nitrogen and oxygen contents.

TABLE 16

Magnetic properties of 33 Nd-1.1 B—Fe alloy after being heat treated at 580° C. for 2 hr as a function of C, N, and O contents.

| Alloy Composition | | | Magnetic Properties | | | |
|---|---|---|---|---|---|---|
| C | N | O | Br | iHc | Hk | (BH)max |
| 0.014 | 0.021 | 0.86 | 12.1 | 11.4 | 8.3 | 33.6 |
| 0.017 | 0.023 | 0.93 | 12.3 | 10.9 | 8.1 | 34.8 |
| 0.034 | 0.022 | 0.75 | 12.1 | 12.3 | 9.7 | 34.2 |
| 0.038 | 0.021 | 0.87 | 12.5 | 12.1 | 9.6 | 36.6 |
| 0.056 | 0.003 | 0.75 | 12.0 | 13.0 | 9.7 | 33.6 |
| 0.055 | 0.024 | 0.82 | 12.4 | 12.1 | 9.3 | 36.0 |

TABLE 17

Magnetic properties of 33.5 Nd-1.1 B—Fe alloy after being heat treated at 550° C. for 2 hr as a function of C, N, and O contents.

| Alloy Composition | | | Magnetic Properties | | | |
|---|---|---|---|---|---|---|
| C | N | O | Br | iHc | Hk | (BH)max |
| 0.070 | 0.080 | 0.62 | 12.1 | 13.1 | 11.7 | 35.3 |
| 0.093 | 0.076 | 0.70 | 12.2 | 13.2 | 10.9 | 35.9 |
| 0.11 | 0.072 | 0.61 | 12.2 | 13.3 | 10.6 | 35.9 |
| 0.15 | 0.064 | 0.68 | 11.9 | 12.5 | 9.2 | 33.7 |
| 0.21 | 0.066 | 0.76 | 11.9 | 11.9 | 9.0 | 33.7 |

TABLE 18

Magnetic properties of 33.5 Nd-1.1 B—Fe alloy after being heat treated at 550° C. for 2 hr as a function of C, N, and O contents.

| Alloy Composition | | | Magnetic Properties | | | |
|---|---|---|---|---|---|---|
| C | N | O | Br | iHc | Hk | (BH)max |
| 0.062 | 0.097 | 0.42 | 12.0 | 12.1 | 9.9 | 34.4 |
| 0.11 | 0.072 | 0.68 | 12.3 | 11.6 | 8.5 | 35.9 |
| 0.22 | 0.058 | 0.42 | 11.9 | 9.8 | 5.6 | 30.5 |
| 0.061 | 0.052 | 0.42 | 12.1 | 11.3 | 9.5 | 34.9 |
| 0.10 | 0.052 | 0.50 | 12.6 | 10.3 | 7.9 | 37.5 |
| 0.062 | 0.086 | 0.52 | 12.0 | 12.4 | 10.2 | 34.6 |
| 0.10 | 0.072 | 0.48 | 12.2 | 10.3 | 7.4 | 34.9 |
| 0.14 | 0.054 | 0.54 | 12.6 | 9.5 | 6.4 | 36.0 |
| 0.20 | 0.032 | 0.40 | 12.1 | 8.5 | 5.8 | 31.9 |
| 0.056 | 0.054 | 0.48 | 12.2 | 11.5 | 9.2 | 35.7 |
| 0.10 | 0.049 | 0.42 | 12.3 | 9.8 | 8.0 | 35.0 |
| 0.13 | 0.046 | 0.41 | 12.1 | 9.0 | 6.0 | 33.0 |

As shown in Table 16 with fixed carbon and nitrogen contents, the higher oxygen content gives slightly higher remanence (Br) and slightly lower intrinsic coercivity (iHc) than at a lower oxygen content. As the carbon content increases from 0.014 to 0.056%, the remanence remains the same and the intrinsic coercivity increases substantially from 11.4 to 13.0 KOe. This indicates that the magnetic properties generally improve as the carbon content increases up to about 0.06%. With higher carbon contents, both remanence and intrinsic coercivity remain the same with carbon content increases from 0.070 to 0.11% and begin to decrease with further increases in the carbon content, as shown by the data presented in Table 17. It should be noted, however, that the squareness and $H_k$ value decrease as the carbon content increases. An additional example of the effects of high carbon are shown in the data presented in Table 18. Unlike the data presented in Table 17, in the tests reported in this table the intrinsic coercivity of the magnet decreased as the carbon content increased from about 0.06%. The remanence slightly increased up to about 0.1% carbon and then decreased with further increases in the carbon content. The squareness and Hk value also decreased as carbon content increased. These results indicate that the magnetic properties as a function of the carbon content vary depending upon the alloy composition. In general, as the carbon content increases up to about 0.06%, the magnetic properties may improve. When the carbon content increases from 0.06 to about 0.11%, the magnetic properties may remain the same or decrease slightly. Further increases in the carbon content may reduce the magnetic properties substantially. When the nitrogen content is relatively low (less than 0.08%), the magnetic properties do not change significantly. However, if the nitrogen content is high (greater than 0.15%) it forms NdN by consuming the neodymium-rich phase, which deteriorates the magnetic properties, densification and corrosion resistance.

As may be seen from the data reported and discussed above in accordance with the invention, the corrosion rate of the magnets decreases with increasing oxygen content and reaches a minimum with an oxygen content within the range of 0.6 to 1.2% with the maximum carbon content being 0.15%. The effect of oxygen on corrosion resistance is dependent upon the carbon and nitrogen contents, which must be maintained within the limits of the invention.

The corrosion resistance is also improved with proper heat treatment to form a protective oxidation resistant layer on the magnet surface.

The magnetic properties also vary with the oxygen, carbon and nitrogen contents.

We claim:

1. A permanent magnet having improved corrosion resistance consisting essentially of $Nd_2$-$Fe_{14}$-B with oxygen 0.6 to 1.2 weight %, carbon 0.05 to 0.1 weight %, and nitrogen 0.02 to 0.15 weight %.

2. The permanent magnet of claim 1 with nitrogen 0.04 to 0.08 weight %.

* * * * *